US010195734B2

(12) United States Patent
Hohmeier

(10) Patent No.: US 10,195,734 B2
(45) Date of Patent: Feb. 5, 2019

(54) TOOL STABILIZER AND METHODS OF ASSEMBLING THE SAME

(71) Applicant: Western Construction Group, Inc., St. Louis, MO (US)

(72) Inventor: William Hohmeier, St. Louis, MO (US)

(73) Assignee: Western Construction Group, Inc., St. Louis, MO (US)

( * ) Notice: Subject to any disclaimer, the term of this patent is extended or adjusted under 35 U.S.C. 154(b) by 0 days.

(21) Appl. No.: 14/733,182

(22) Filed: Jun. 8, 2015

(65) Prior Publication Data

US 2015/0360363 A1 Dec. 17, 2015

Related U.S. Application Data

(60) Provisional application No. 62/011,476, filed on Jun. 12, 2014.

(51) Int. Cl.

*B25H 1/00* (2006.01)
*E04G 5/00* (2006.01)
*E04G 5/14* (2006.01)

(52) U.S. Cl.

CPC ..... *B25H 1/0028* (2013.01); *E04G 5/00* (2013.01); *E04G 5/003* (2013.01); *E04G 5/14* (2013.01); *Y10T 29/49828* (2015.01); *Y10T 29/49876* (2015.01)

(58) Field of Classification Search

CPC ..... E04G 2005/008; E04G 7/28; E04G 5/00; E04G 5/14; Y10T 29/49828

See application file for complete search history.

(56) References Cited

U.S. PATENT DOCUMENTS 696,554 A 4/1902 Dudley
1,131,777 A * 3/1915 Gage ..... B23Q 11/0017 408/235
1,305,834 A * 6/1919 Rand ..... B28D 1/226 125/8
1,349,209 A * 8/1920 Kirchner ..... B65D 90/623 105/310.1
1,448,428 A * 3/1923 Bowman ..... B25B 23/141 310/50
1,676,197 A * 7/1928 Marrinan ..... E02D 5/80 411/457

(Continued)

FOREIGN PATENT DOCUMENTS

WO WO 0211521 A1 * 2/2002 ..... B25H 1/0028

*Primary Examiner* — Katherine W Mitchell
*Assistant Examiner* — Candace L Bradford
(74) *Attorney, Agent, or Firm* — Armstrong Teasdale LLP

(57) ABSTRACT

In one aspect, a tool stabilizer system is provided. The tool stabilizer system includes a support deck, a mast coupled to the support deck, and a beam coupled to the mast. The beam includes a first end, a second end, and a body extending between the first end and the second end. A pulley system is coupled to the beam. The pulley system includes a first pulley coupled to the first end, a second pulley coupled to the second end, and a cable coupled to the first pulley and the second pulley. The cable includes a first end and a second end. The tool stabilizer system further includes a counter weight coupled to the cable first end proximate the first pulley and a tool coupled to the cable second end proximate the second pulley.

13 Claims, 4 Drawing Sheets

(56) References Cited

U.S. PATENT DOCUMENTS 1,982,963 A * 12/1934 Post ..... E02D 5/803 411/347
2,176,979 A * 10/1939 Platz ..... B23K 11/318 212/341
2,262,310 A * 11/1941 Wooldridge ..... E02F 3/6472 267/255
2,496,264 A * 2/1950 Benson ..... H01Q 1/10 403/106
2,506,048 A * 5/1950 Van den Akker ..... G01N 3/062 73/852
2,837,915 A * 6/1958 Brown, Jr. ..... G01N 3/14 73/831
3,543,872 A * 12/1970 Halls ..... B62D 49/0657 180/208
3,577,715 A * 5/1971 Halls ..... A01D 43/10 56/208
3,759,346 A * 9/1973 Brda ..... A62B 1/14 182/7
3,804,263 A * 4/1974 Castonguay ..... B60P 1/548 212/180
3,810,593 A * 5/1974 Krysl ..... A63G 25/00 242/403
3,854,153 A * 12/1974 Fadler ..... A47C 17/23 5/13
4,144,843 A * 3/1979 Schrougham ..... A01K 1/04 119/786
4,213,624 A * 7/1980 Sanders ..... B62B 3/0606 280/43.12
4,223,906 A * 9/1980 Gratza ..... B62H 1/02 180/219
4,315,387 A * 2/1982 Lee ..... E02D 5/80 52/156
4,440,261 A * 4/1984 Clark ..... A62B 1/06 182/142
4,512,438 A * 4/1985 Vilchek ..... A62B 1/12 182/238
4,703,831 A * 11/1987 Forrest ..... A62B 1/06 182/3
4,721,301 A * 1/1988 Drake ..... A63B 21/0628 482/102
4,838,439 A * 6/1989 Baziuk ..... A62B 5/00 182/3
4,925,226 A * 5/1990 Leonard, Jr. ..... B66C 1/663 294/102.1
5,069,293 A * 12/1991 St. Romain ..... A01B 45/02 171/144
5,199,507 A * 4/1993 Westmoreland ..... E21B 19/084 173/147
5,242,347 A * 9/1993 Keeton ..... A63B 23/025 482/10
5,423,386 A * 6/1995 Lapearous ..... A01B 45/02 172/22
5,433,044 A * 7/1995 Walcher ..... A62B 35/0068 52/111
5,762,279 A * 6/1998 Horton, III ..... E21B 19/02 254/285
5,950,373 A * 9/1999 von Hoff ..... E02D 27/01 206/321
5,979,601 A * 11/1999 Lu ..... A62B 1/10 182/231
5,992,864 A * 11/1999 Dickson ..... B62K 3/002 280/87.041
6,007,031 A * 12/1999 Tang ..... B62B 1/045 248/96
6,019,330 A * 2/2000 Affrunti ..... E04D 15/00 182/45
6,041,730 A * 3/2000 Oliverio ..... B63B 21/26 114/230.13
6,087,611 A * 7/2000 De Bruyn ..... B23K 11/28 219/86.21
6,227,553 B1 * 5/2001 Palmer ..... A62B 35/0068 280/47.18
6,315,059 B1 * 11/2001 Geldean ..... E21B 7/028 173/112
6,401,863 B1 * 6/2002 Kirkland ..... B66D 3/20 182/142
6,412,230 B1 * 7/2002 Zambelli ..... E04G 21/3261 52/27
6,481,108 B1 * 11/2002 Helinski ..... B25H 1/0028 224/262
6,491,606 B1 * 12/2002 Swift ..... A63B 22/0605 482/57
6,776,259 B1 * 8/2004 Murten ..... E04G 5/00 182/129
7,014,011 B1 * 3/2006 Alexander ..... B66B 9/16 182/145
7,032,710 B2 * 4/2006 Anderson ..... A62B 35/0068 182/16
7,070,059 B1 * 7/2006 Flowers ..... B60P 1/548 212/180
7,377,487 B2 * 5/2008 Otten ..... B25H 1/0028 248/322
7,568,575 B2 8/2009 Kalantari
7,901,173 B2 * 3/2011 Spilker ..... E04H 17/263 414/23
8,550,023 B1 * 10/2013 Quail ..... B63B 21/26 114/230.13
8,584,798 B2 * 11/2013 Stoffels ..... A62B 99/00 182/3
8,911,328 B2 12/2014 Alessandri et al.
8,992,152 B2 3/2015 Nouwens et al.
2002/0185335 A1 * 12/2002 Verdyk ..... E04G 5/06 182/3
2003/0154589 A1 * 8/2003 Koch ..... A47C 23/00 29/525.02
2005/0061581 A1 * 3/2005 Morris ..... E04G 1/20 182/82
2006/0107605 A1 * 5/2006 Krahn ..... E02D 5/80 52/155
2007/0122263 A1 * 5/2007 Pfeiffer ..... B65B 69/0083 414/810
2007/0289811 A1 * 12/2007 Smith ..... A62B 35/04 182/3
2008/0022546 A1 * 1/2008 Trudel ..... A45D 20/12 34/90
2008/0300115 A1 * 12/2008 Erlandson ..... A63B 22/0235 482/54
2009/0321184 A1 * 12/2009 Hamilton ..... A62B 99/00 182/3
2010/0283222 A1 * 11/2010 Lin ..... B62H 1/04 280/303
2010/0300017 A1 * 12/2010 Bulloch ..... B63B 21/40 52/157
2012/0222909 A1 * 9/2012 Llopiz-Capote ..... A01D 34/003 180/291

* cited by examiner

TOOL STABILIZER AND METHODS OF ASSEMBLING THE SAME

CROSS REFERENCE TO RELATED APPLICATIONS

This application is a non-provisional and claims priority to U.S. Provisional Patent Application 62/011,476 filed Jun. 12, 2014, which is hereby incorporated by reference in its entirety.

BACKGROUND

The embodiments described herein relate generally to construction tool supports, and more particularly, to methods and systems for stabilizing and balancing tools on support platforms.

In some construction restoration projects such as, for example, tuck pointing, workers stand on a suspended platform such as a swing stage or scaffolding to remove mortar between bricks and stones, and then replace the mortar with new material to strengthen the structure. The suspended platform may connect to a building roof and suspend along the side of the building. Alternatively, the scaffold may be built from the ground up along the side of the building. The worker may use tools such as grinders to remove the mortar between two bricks on the building so that tuck pointing may be completed.

Some existing grinders may not break up hard mortar. Consequently, the worker may have to spend more time grinding which may lead to tool degradation, labor fatigue, and/or reduced production. Other tools, for example chop saws, may break up hard mortar more efficiently than grinders in certain applications, such as for use with large masonry stones. These other tools, however, can be heavier and bulkier than grinders. While the worker handles heavier tools, the tools may apply increased stress to the workers' hands, forearms, shoulders, and backs. The increased stress may lead to injury and reduced production.

Moreover, in conventional restoration projects, workers may repeatedly lift and lower the tools between a working position where the workers is using the tool to a resting position where the tool is placed on the work platform when the worker is performing a different task. The repeated lifting and lowering of the tool from the platform to the working position may lead to repetitive injuries, lost tools, and/or safety issues such as trip hazards and blocked walkways. Workers need to be able to handle heavy and bulky tools while minimizing stresses applied to the worker's body. Moreover, workers need to be able to handle heavy and bulky tools in an efficient manner to increase production performance.

BRIEF DESCRIPTION OF THE INVENTION

In one aspect, a tool stabilizer system is provided. The tool stabilizer system includes a support deck, a mast coupled to the support deck, and a beam coupled to the mast. The beam includes a first end, a second end, and a body extending between the first end and the second end. A pulley system is coupled to the beam. The pulley system includes a first pulley coupled to the first end, a second pulley coupled to the second end, and a cable coupled to the first pulley and the second pulley. The cable includes a first end and a second end. The tool stabilizer system further includes a counter weight coupled to the cable first end proximate the first pulley and a tool coupled to the cable second end proximate the second pulley.

In another aspect, a tool stabilizer system is provided. The tool stabilizer system includes a support deck and a tool stabilizer coupled to the support deck. The tool stabilizer includes a sleeve coupled to the support deck. The tool stabilizer further includes a mast coupled to the sleeve and a beam coupled to the mast. The beam includes a first end, a second end, and a body extending between the first end and the second end. A pulley system is coupled to the beam, and a cable is coupled to the pulley system. The tool stabilizer system further includes a counter weight coupled to the pulley system via the cable.

A method of assembling a tool stabilizer is provided. The method includes coupling a sleeve to a support deck, coupling a mast to the sleeve, and coupling a beam to the mast. The method also includes coupling a pulley system to the beam. Moreover, the method includes coupling a cable to the pulley system and coupling a counter weight to the pulley system via the cable.

BRIEF DESCRIPTION OF THE DRAWINGS

These and other features, aspects, and advantages will become better understood when the following detailed description is read with reference to the accompanying drawings in which like characters represent like parts throughout the drawings, wherein.

Unless otherwise indicated, the drawings provided herein are meant to illustrate features of embodiments of the disclosure. These features are believed to be applicable in a wide variety of systems comprising one or more embodiments of the disclosure. As such, the drawings are not meant to include all conventional features known by those of ordinary skill in the art to be required for the practice of the embodiments disclosed herein.

DETAILED DESCRIPTION

In the following specification and the claims, reference will be made to a number of terms, which shall be defined to have the following meanings The singular forms "a", "an", and "the" include plural references unless the context clearly dictates otherwise. "Optional" or "optionally" means that the subsequently described event or circumstance may or may not occur, and that the description includes instances where the event occurs and instances where it does not.

Approximating language, as used herein throughout the specification and claims, may be applied to modify any quantitative representation that could permissibly vary without resulting in a change in the basic function to which it is related. Accordingly, a value modified by a term or terms, such as "about", "approximately", and "substantially", are not to be limited to the precise value specified. In at least some instances, the approximating language may correspond to the precision of an instrument for measuring the value. Here and throughout the specification and claims, range limitations may be combined and/or interchanged;

such ranges are identified and include all the sub-ranges contained therein unless context or language indicates otherwise.

The embodiments described herein relate to stabilizing construction tools and methods of using construction tools. The embodiments also relate to methods, systems, and/or apparatus for suspending and selectively positioning tools with respect to a suspended platform such as a swing stage or a scaffolding platform during operation of the tool. The embodiments also describe systems and methods to minimize stresses of the tool weight being applied to the worker. The embodiments described herein include a variety of types of tools, and the descriptions and figures that utilize construction tools are examples only. The example system manages tool operation to reduce stresses applied to a worker to increase efficiency.

Figure 1:
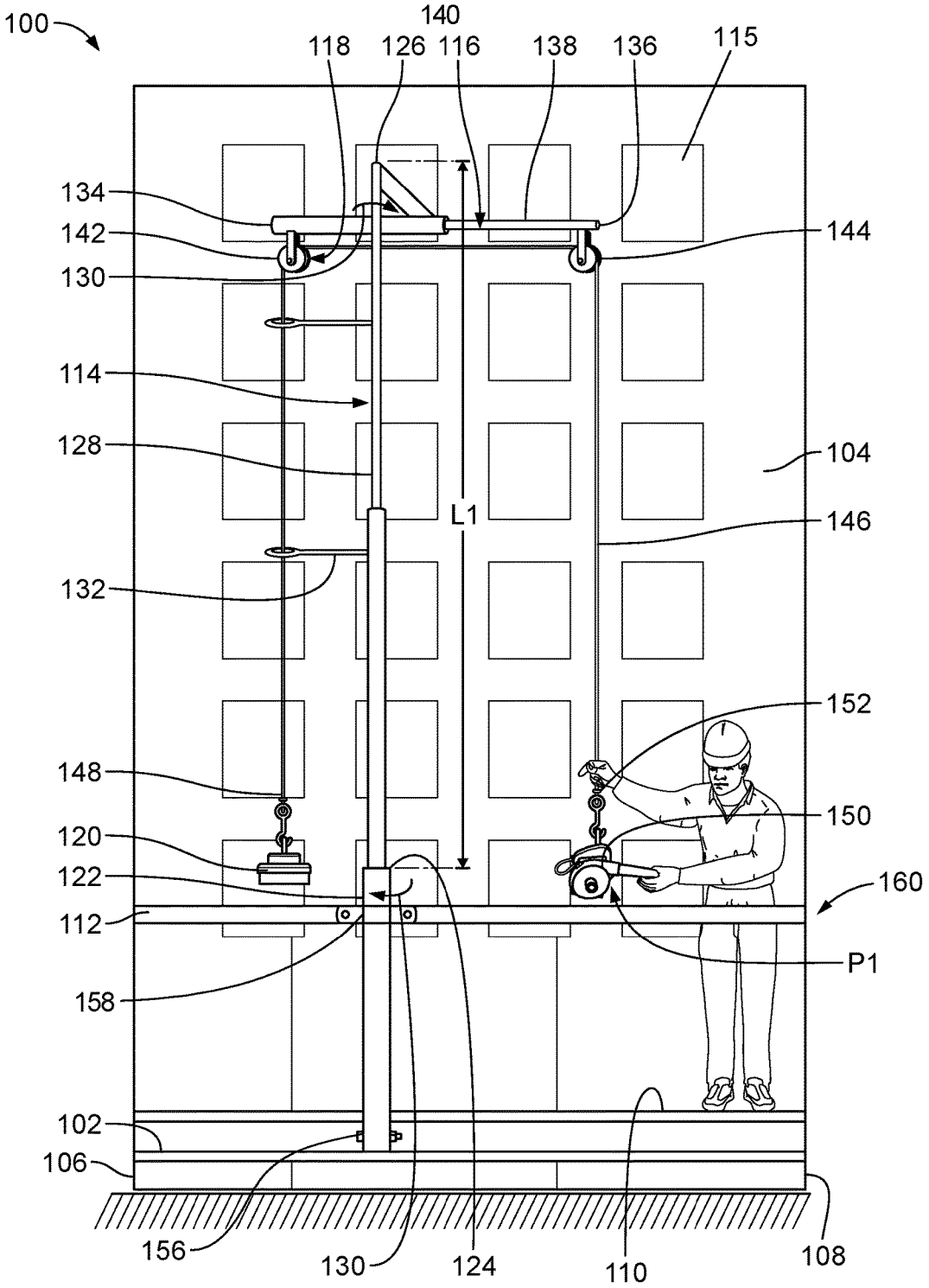
FIG. 1 is a side elevational view of an exemplary tool stabilizer coupled to a support and in a first position.
Figure 2:
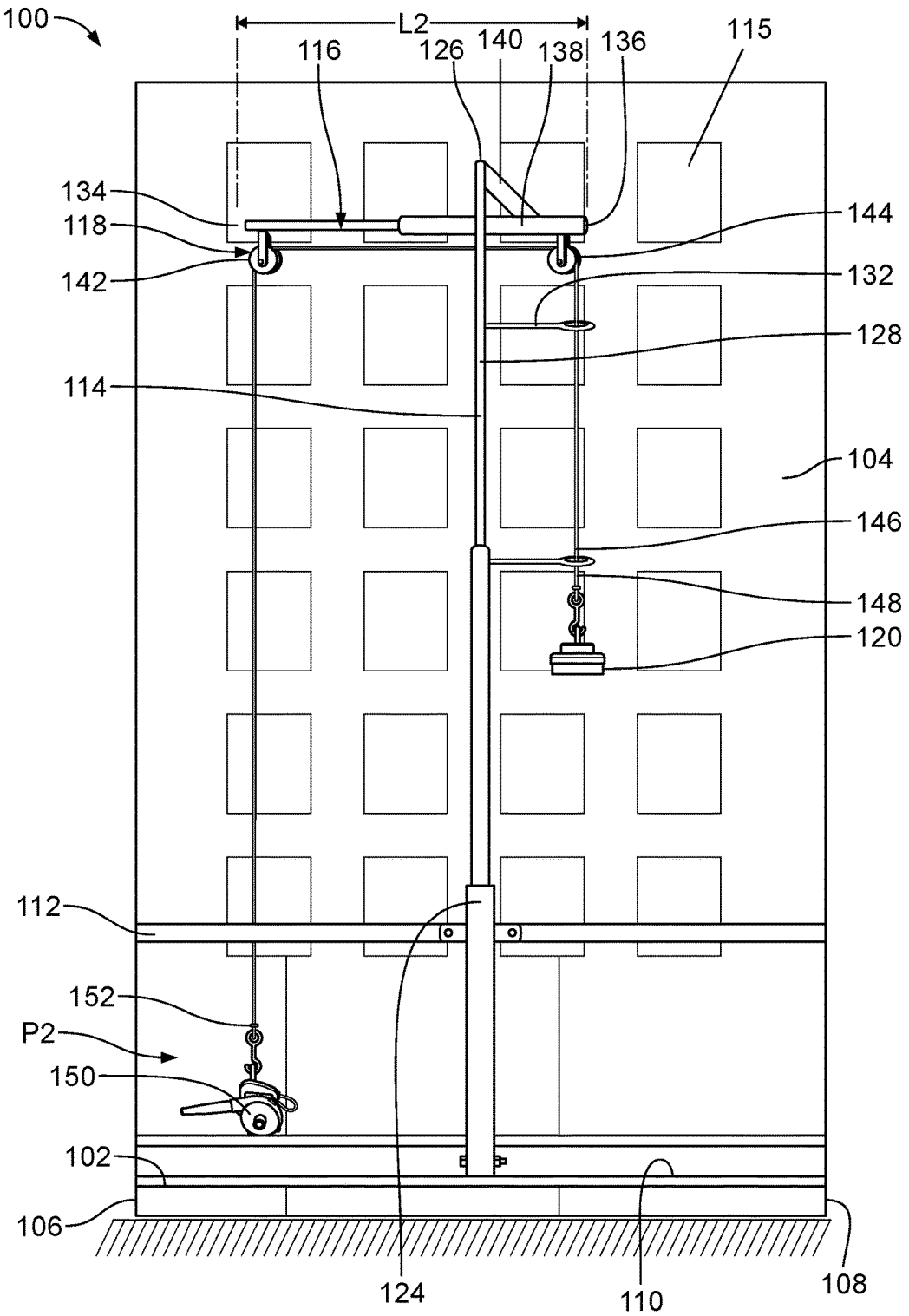
FIG. 2 is a side elevational view of the tool stabilizer shown in FIG. 1 in a second position.

FIG. 1 is a side elevational view of tool stabilizer 100 coupled to a support 102 and in a first position P1. FIG. 2 is a side elevational view of tool stabilizer 100 shown in a second position P2. In the exemplary embodiment, support 102 includes a suspended platform such as, but not limited to, a swing stage, a scaffold, a cherry picker, a scissor lift, or any other elevated work platform. Alternatively, support 102 may include any configuration to enable workers to stand near a building façade 104 which may include windows 115. Support 102 includes a first end 106, a second end 108, and a walkway 110 extending between first end 106 and second end 108. Support 102 further includes a safety rail 112. Support 102 is configured to suspend alongside building façade 104 by cables or lanyards (not shown).

Tool stabilizer 100 is coupled to support 102. More particularly, tool stabilizer 100 is coupled to safety rail 112. Alternatively, tool stabilizer 100 can be coupled to any portion of support 102 and/or building. In the exemplary embodiment, tool stabilizer 100 includes a mast 114, a beam 116, a pulley system 118, and a counter weight 120. Stabilizing tool 100 further includes a sleeve 122 configured to coupled mast 114 to support 102. More specifically, sleeve 122 is a cylindrical tube coupled to safety rail 112 and to support deck 102 proximate walkway 110. Sleeve 122 receives at least a portion of mast 114 therein until mast 114 contacts a stopper 156 coupled to sleeve 122. Alternatively, mast 114 may be coupled to support deck 102 using any type of fastener, for example, a sleeve, a coupler, bracket, clamp, weld, and a bushing.

In one embodiment, sleeve 122 is coupled to support 102 using at least one removable fastener 158, such as, but not limited to a clamp, such that sleeve 122 can be moved between different positions along support. In another embodiment, tool stabilizer 100 includes a rail system 160 that enables sleeve 122 and mast 114 to slide along support 102 to a different work area. For example, a worker removably secures sleeve 122 to rail system 160 at a first position to perform work at a first area. When work at the first work area is complete, the worker uncouples sleeve 122 from the first position and slides sleeve 122 along support 102 using rail system 160 to a second position that is associated with a second work area.

Mast 114 includes a first end 124, a second end 126, and a body 128 extending between first end 124 and second end 126. Moreover, body 128 extends along an axis of rotation 130 between first end 124 and second end 126. In the exemplary embodiment, body 128 includes a fixed length L1 from about one foot to about thirty feet. More particularly, body 128 includes a fixed length L1 of about fifteen feet. In another embodiment, mast body 128 includes an adjustable length L1 that enables the worker to determine the length L1 for a particular work area. More specifically, mast body 128 includes a telescoping feature that enables body 128 to extend from a collapsed position to an extended position, and any position therebetween. Some building facades 104 may include outcroppings, such as awnings or balconies that may limit the available length L1 of mast body 128. A telescoping mast 114 enables the worker to determine the length L1 of body 128 to avoid any conflicts with building outcroppings. Furthermore, the telescoping feature of mast body 128 provides for an easy transport of tool stabilizer 100 to the worksite. In general, body 128 includes any length for mast 114 to safely suspend beam 116 and pulley system 118 from suspended platform 102.

In the exemplary embodiment, mast 114 is rotatably coupled to sleeve 122 and configured to rotate up to 360° about axis of rotation 130. Mast 114 further includes cable guides 132 coupled to body 128 and extending outward from body 128. Each guide 132 includes a configuration such as, but not limited to, an eyebolt, a groove, and a sleeve. Alternatively, guide 132 can include any configuration to facilitate operation of pulley system 118 as described herein. In operation, a cable 146 is threaded through guides 132 to facilitate proper positioning of cable 146 and to prevent cable 146 from wrapping around mast 114, as described in further detail below.

Beam 116 is coupled to mast 114. In an embodiment, beam 116 is rotatably coupled to body 128 and configured to rotate up to 360° about axis of rotation 130. Beam 116 includes a first end 134, a second end 136, and a body 138 extending between first end 134 and second end 136. In the exemplary embodiment, body 138 includes a fixed length L2 from about one foot to about ten feet. More particularly, body 138 includes fixed length L2 of about three feet.

Tool stabilizer 100 may be used on different types of supports 102 that have different widths. As such, it is desirable that beam body 138 is able to be adjusted with respect to mast 114 to account for different walkway widths. In one embodiment, beam body 138 has a fixed length L2, as described above, but the position of beam 114 is moveable with respect to mast 114. More specifically, a worker can slidably adjust the location of mast 114 along beam body 138 in a direction perpendicular to axis 130 to account for different walkway widths. In another embodiment, beam body 138 has a telescoping adjustment feature that enables body 138 to extend from a collapsed position to an extended position, and any position therebetween. More specifically, when tool stabilizer is in use with a support 102 having a relatively wide deck walkway 110, then beam body 138 is extended to have a length L2 that is longer than when tool stabilizer 100 is in use with a support 102 having a narrower walkway 110. Generally, body 138 includes any length for beam 116 to safely suspend pulley system 118.

Furthermore, beam 116 is also slidably moveable along mast body 128 in a direction parallel to axis 130. More specifically, a worker may adjust the position of beam 116 to any location between mast ends 124 and 126 to facilitate completing work at a work area. As described above, at least some building facades 104 include various outcroppings that may limit the positioning of beam 116 and mast 114. Accordingly, an adjustable position of beam 116 along mast 114 facilitates working around such outcroppings. Moreover, a cross support 140 is coupled to mast 114 and beam 116 and is configured to facilitate supporting and stabilizing beam 116 with respect to body 128.

Pulley system 118 is coupled to beam 116 and includes a first pulley 142 coupled to first end 134 and a second pulley 144 coupled to second end 136. A cable 146 is coupled to first pulley 142 and second pulley 144. First pulley 142 and second pulley 144 can include any configuration to facilitate translation of cable 146 as tool 150 reciprocates between first position P1 and second position P2. Moreover, counter weight 120 is removably coupled to end 148 of cable 146. Counter weight 120 includes a weight range from about one pound to about fifty pounds. More particularly, counter weight 120 includes a weight range from about fifteen pounds to about twenty pounds. Counter weight 120 can include any weight to enable pulley system 118 to function as described herein. Moreover, counter weight 120 includes a plurality of varying weights. Alternatively, counter weight 120 can include a single weight.

Moreover, a tool 150 such as, but not limited to, a grinder, a chop saw, a caulker, and an impact hammer is removably coupled to end 152 of cable 146. Alternatively, tool 150 can be any type of tool 150 used to facilitate construction processes. Counter weight 120 is configured to selectively suspend tool 150 from walkway 110 between first position P1 and second position P2. In first position P1, tool 150 is suspended to efficiently, safely, and conveniently position tool 150 for worker to grasp, move, and operate tool 150. In second position P2, tool 150 is safely and securely put on walkway 110. Counter weight 120 is configured to be slightly less weight than tool 150 such that in the event the worker drops tool 150, counter weight 150 allow tool 150 to slowly and safely fall to walkway 110.

To facilitate suspending tool 150, guide 132 is configured to couple to cable 146 between counter weight 120 and first pulley 142 to facilitate stabilizing and guiding cable 146 as tool 150 moves between first position P1 and second position P2. Alternatively, guide 132 can be configured to couple to cable 146 between tool 150 and second pulley 144 to facilitate stabilizing and guiding cable 146 as tool 150 moves between first position P1 and second position P2.

During an exemplary operation, tool 150 is placed on walkway 110 in second position P2 and tool 150 is sized to suspend counter weight 120 away from walkway 110. Worker picks up tool 150 and moves tool 150 to first position P1. Counter weight 120 is configured to counter balance the weight of tool 150 to facilitate ergo dynamically, efficiently, and safely handling of tool 150 by worker while tool 150 is in second position P2. Moreover, since mast 114 is rotatably coupled to safety rail 112 and/or beam 116 is rotatably coupled to mast 114, worker can conveniently and selectively move tool 150 as worker walks along walkway 110. The mast 114 length and/or beam 116 length facilitates the worker selectively covering a reach range for the tool 150 as the worker walk along the walkway 110. For example, the worker couples the mast 114 to safety rail 112 at a preferred position and can rotate mast 114 and/or beam 116 about axis of rotation 130 to move tool 150 to a plurality of positions based at least on one of mast length, beam length, and cable length.

While worker handles tool 150, counter weight 120 facilitates suspending tool 150 in second position P2 to reduce stress applied to at least one of the worker's hands, arms, shoulders, and back. Moreover, counter weight 120 facilitates suspending tool 150 in second position P2 to assist movement and placement of tool 150 during tool operation to increase production performance. After tool operation, worker places tool 150 onto walkway 110 to second position P2. Counter weight 120 is sized to facilitate tool 150 resting on walkway 110. Moreover, cable 146 is configured to secure tool 150 on walkway 110 in second position P2.

Figure 3:
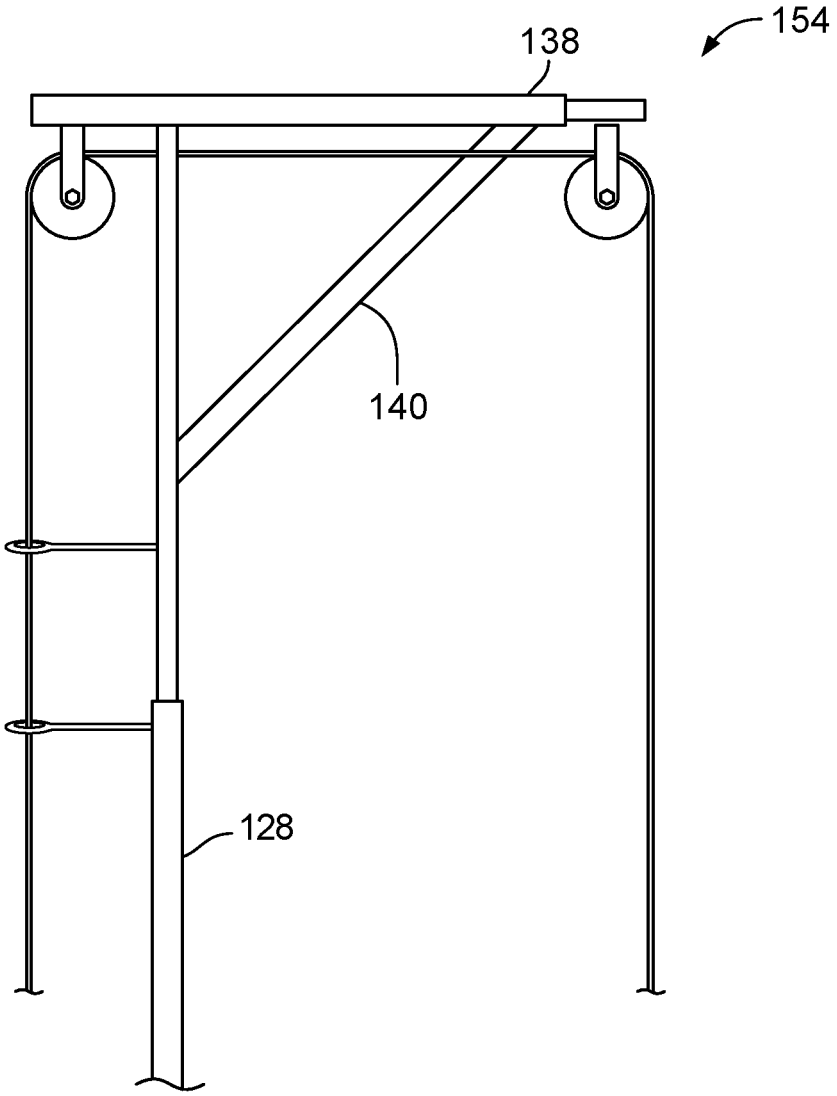
FIG. 3 is a side elevational view of another exemplary tool stabilizer.

FIG. 3 is a side elevational view of another exemplary tool stabilizer 154. In the exemplary embodiment, cross support 140 is coupled to mast body 128 and beam body 138 and is configured to facilitate stabilizing, supporting, and suspending beam 116 with respect to mast 114. Furthermore, both mast body 128 and beam body 138 are shown in their respective collapsed positions, as described above.

Figure 4:
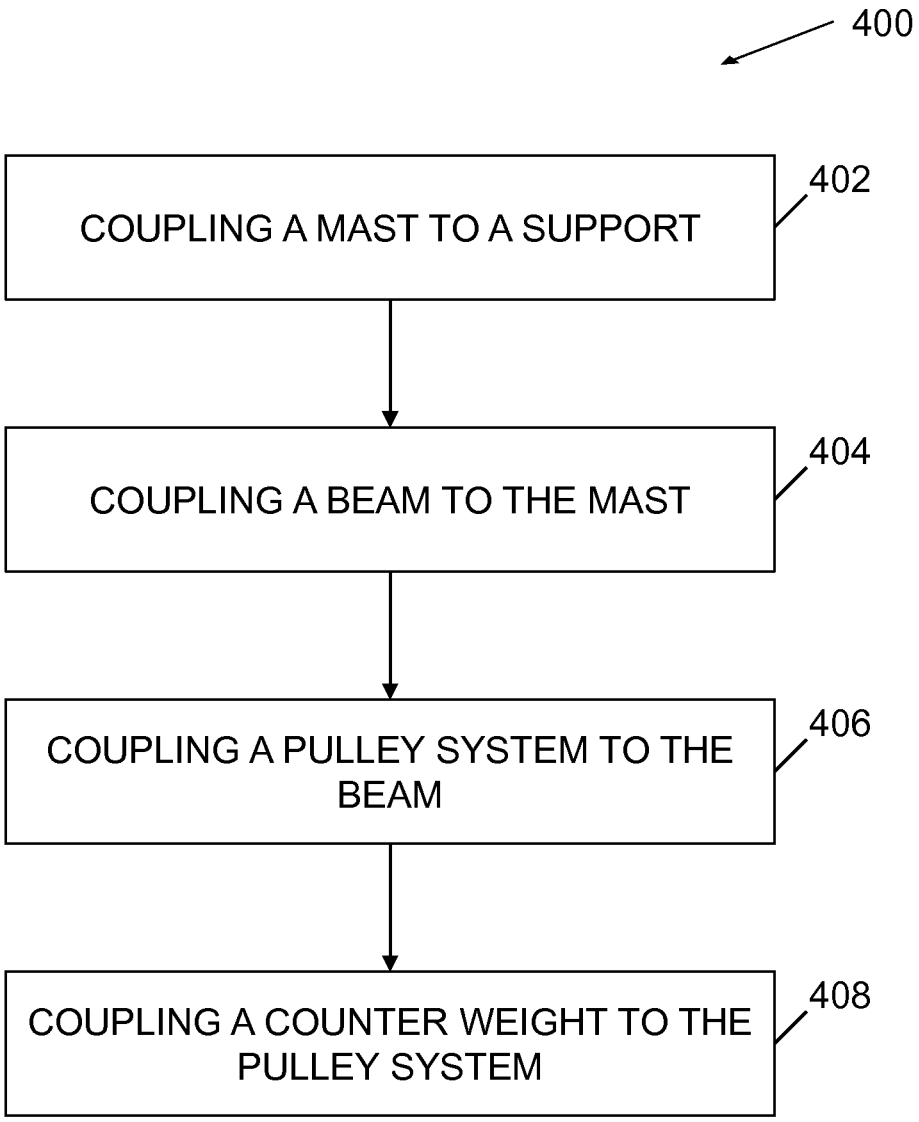
FIG. 4 is a flowchart illustrating an exemplary method of assembling the tool stabilizer shown in FIG. 1.

FIG. 4 is a flowchart illustrating an exemplary method 400 of assembling a tool stabilizer, such as tool stabilizer 100 (shown in FIG. 1). Method 400 includes coupling 402 mast 114 to support 102 (both shown in FIG. 1). In the exemplary method 400, beam 116 is coupled 404 to mast 114 (both shown in FIG. 1). Method 400 includes coupling 406 pulley system 118 to beam 116 (both shown in FIG. 1). Moreover, method 400 includes coupling 408 counter weight 120 to pulley system 118 (both shown in FIG. 1).

The embodiments described herein provide cost-effective, safe, and efficient operation of tools such as construction tools. More particularly, the exemplary embodiments enable utilizing a counter weight and pulley system to facilitate suspending the tool for safety, ergo dynamic, and production reasons. Moreover, the embodiments described herein provide for increased reach range of the tool as a worker walks along a walkway. Still further, the embodiments described herein mitigate stresses applied by a tool's weight to the worker. The embodiments provide for decreasing maintenance and/or replacement costs for the tool.

A technical effect of the systems and methods described herein includes at least one of: (a) utilizing a counter weight and a pulley system; (b) suspending a tool during tool operation; (c) securing a tool on walkway; (d) managing and/or mitigating stresses applied by the tool's weight to a worker; (f) increasing operating efficiency of a worker and/or a tool; and, (g) decreasing maintenance and/or replacement costs for construction tools.

Exemplary embodiments of a tool stabilizer and methods for assembling a tool stabilizer are described herein. The methods and systems are not limited to the specific embodiments described herein, but rather, components of systems and/or steps of the methods may be utilized independently and separately from other components and/or steps described herein. For example, the methods may also be used in combination with other manufacturing systems and methods, and are not limited to practice with only the systems and methods as described herein. Rather, the exemplary embodiment may be implemented and utilized in connection with many other tool applications.

Although specific features of various embodiments of the invention may be shown in some drawings and not in others, this is for convenience only. In accordance with the principles of the invention, any feature of a drawing may be referenced and/or claimed in combination with any feature of any other drawing.

This written description uses examples to disclose the embodiments, including the best mode, and also to enable any person skilled in the art to practice the embodiments, including making and using any devices or systems and performing any incorporated methods. The patentable scope of the disclosure is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

What is claimed is:

1. A tool stabilizer system comprising:

a support deck;

a mast;

a sleeve removably coupled directly to said support deck and to said mast, wherein said sleeve comprises a cylindrical tube configured to receive a portion of said mast therein, wherein said mast is configured to rotate about an axis within said sleeve during operation, wherein said sleeve is coupled to said support deck via a removable fastener such that said sleeve is selectively movable along said support deck;

a beam coupled to said mast and comprising a beam first end, a beam second end, and a beam body extending between said beam first end and said beam second end;

a pulley system coupled to said beam and comprising:

a first pulley coupled to said beam first end;

a second pulley coupled to said beam second end; and a cable coupled to said first pulley and said second pulley and comprising a cable first end and a cable second end;

a counter weight coupled to said cable first end proximate said first pulley;

a tool coupled to said cable second end proximate said second pulley, wherein said mast is configured to rotate within said sleeve during operation to facilitate positioning of said tool; and a rail system configured to facilitate sliding said sleeve and said mast along said support deck between a first work area and a second work area.

2. The tool stabilizer of claim 1, wherein said support deck comprises an elevated work platform.

3. The tool stabilizer of claim 1 further comprising a cross support coupled between said mast and said beam and oriented obliquely to both said mast and said beam.

4. The tool stabilizer of claim 1 further comprising a cable guide coupled to said mast.

5. The tool stabilizer of claim 1, wherein said mast comprises an adjustable telescopic length between a collapsed position and an extended position.

6. The tool stabilizer of claim 1, wherein said beam comprises a telescopic length between a collapsed position and an extended position.

7. The tool stabilizer of claim 1, wherein a position of said beam is adjustable along said mast in a direction perpendicular to said mast.

8. The tool stabilizer of claim 1, further comprising a stopper coupled to said sleeve and spaced a distance from said support deck, wherein said stopper is configured to support said mast such that said mast is spaced a distance from said support deck by said stopper.

9. A tool stabilizer system comprising:

a support deck; and a tool stabilizer coupled to said support deck and comprising:

a sleeve removably coupled directly to said support deck via a removable fastener such that said sleeve is movable along said support deck, wherein said sleeve comprises a cylindrical tube;

a mast rotatably coupled to said sleeve, wherein said sleeve receives a portion of said mast and said mast configured to rotate about an axis within said sleeve during operation to facilitate positioning of a tool;

a stopper extending horizontally through said sleeve and spaced a distance from said support deck, wherein said stopper is configured to support said mast such that said mast is spaced a distance from said support deck by said stopper;

a beam coupled to said mast and comprising a first end, a second end, and a body extending between said first end and said second end; and a pulley system coupled to said beam;

a cable coupled to said pulley system; and a counter weight coupled to said pulley system via said cable.

10. The tool stabilizer system of claim 9, wherein said pulley system comprises a first pulley coupled to said first end and a second pulley coupled to said second end.

11. The tool stabilizer system of claim 9, further comprising a rail system configured to facilitate sliding said sleeve and said mast along said support deck between a first work area and a second work area.

12. The tool stabilizer system of claim 9, wherein at least one of said mast and said beam comprises an adjustable length between a collapsed position and an extended position.

13. The tool stabilizer system of claim 9, wherein a position of said beam is adjustable along said mast.

* * * * *